US012089630B2

(12) United States Patent
Maurer

(10) Patent No.: US 12,089,630 B2
(45) Date of Patent: Sep. 17, 2024

(54) COMBINATION BEVERAGE CONTAINER AND SMOKING APPARATUS

(71) Applicant: Christian Maurer, Goose Creek, SC (US)

(72) Inventor: Christian Maurer, Goose Creek, SC (US)

( * ) Notice: Subject to any disclaimer, the term of this patent is extended or adjusted under 35 U.S.C. 154(b) by 387 days.

(21) Appl. No.: 17/451,181

(22) Filed: Oct. 18, 2021

(65) Prior Publication Data

US 2023/0117422 A1 Apr. 20, 2023

(51) Int. Cl.

| | |
|---|---|
| ***A24F 1/30*** | (2006.01) |
| ***A24F 3/00*** | (2006.01) |
| ***A47G 19/22*** | (2006.01) |

(52) U.S. Cl.

CPC ..... *A24F 3/00* (2013.01); *A24F 1/30* (2013.01); *A47G 19/2205* (2013.01)

(58) Field of Classification Search

None

See application file for complete search history.

(56) References Cited

U.S. PATENT DOCUMENTS

| | | | | |
|---|---|---|---|---|
| 4,161,954 | A | 7/1979 | Fornaciari | |
| 4,198,993 | A | 4/1980 | Martin et al. | |
| 6,073,632 | A | 6/2000 | Tolja | |
| 8,689,802 | B2 | 4/2014 | Schoenfeld | |
| 9,233,217 | B2 | 1/2016 | Jones | |
| 9,445,630 | B1 * | 9/2016 | Modi | A24F 1/30 |
| 9,788,574 | B2 | 10/2017 | Mullen et al. | |
| 2016/0095351 | A1 | 4/2016 | Carrion | |
| 2016/0183590 | A1 | 6/2016 | Bert | |
| 2023/0007878 | A1 * | 1/2023 | Rhodes | A24F 1/26 |

OTHER PUBLICATIONS

Wikihow ("How to Make a Pipe from a Soda Can (with Pictures)", <https://www.wikihow.com/Make-a-Pipe-from-a-Soda-Can>, Aug. 21, 2019 (Year: 2019).*

* cited by examiner

*Primary Examiner* — Katherine A Will

(74) *Attorney, Agent, or Firm* — Southeast IP Group LLC; Thomas L. Moses

(57) ABSTRACT

A combination beverage container and smoking device includes a beverage container, with a cylindrical body member formed by a circular sidewall, having a closed top member, with a pre-cut opening to form a mouth and an opening mechanism, and a closed bottom member. The sidewall of the cylindrical body member includes a bowl and a carburetor. Removable covers are attached to the sidewall of the cylindrical body member and cover both the bowl and the carburetor. After consuming the liquid inside the container, and when ready to smoke, the user simply removes the cover, places his smoking substance on the screen, heats up the smoking substance, and inhales by placing his mouth at the pre-cut opening.

11 Claims, 13 Drawing Sheets

COMBINATION BEVERAGE CONTAINER AND SMOKING APPARATUS

The present invention relates generally to a beverage container that can be converted into a device used for smoking tobacco, cannabis, or other smoking substances. More specifically, the present invention includes a beverage container preferably having a generally cylindrical body, a closed top member with a pre-cut opening to form a mouth designed to be opened using an opening mechanism, a closed bottom member, and a removable cover that is removably attached to the outer sidewall of the cylindrical body, wherein the removable cover may be removed to reveal a perforated indentation positioned thereunder on the sidewall that forms a bowl for placement tobacco or other substances. This configuration is particularly useful for smoking substances such as tobacco, cannabis, or other substances after drinking or otherwise disposing of the beverage within the can.

Heretofore, many efforts have been made to provide smoking and drinking devices and the like. Some examples are set forth hereinbelow, and each of the following references are incorporated herein by reference, in their entireties:

U.S. Pat. No. 4,161,954—Smoking Apparatus

A smoking apparatus comprising a pipe bowl for holding burning smoking material, means for connecting the pipe bowl to a means for containing water, means for drawing smoke from the pipe bowl through water contained in the water-containing means before it is discharged from the apparatus and valve means located in the pipe bowl, having a closed position for preventing smoking material in the pipe bowl from falling into the water-containing means and an open position for dumping the residue and ash from the smoking material burned in the pipe bowl into the water-containing means. The pipe bowl comprises a generally cylindrical interior surface. In one embodiment the valve means comprises a disk-shaped member and means connected to the disk-shaped member and means connected to the disk-shaped member for rotating the disk-shaped member between its open and closed positions. In a second embodiment, the valve means comprises a slidable member, a hole in one half of the slidable member and means for sliding the slidable member between closed and open positions for selectively placing the hole relative to the pipe bowl and the interior of the water-containing means. Separate and apart from the valve means there is disclosed means for storing smoking material prior to its placement in the pipe bowl, means for attaching the storing means to the water-containing means, and means for mounting the pipe bowl within the interior of the storing means for catching spillage of smoking material from the pipe bowl when the pipe bowl is loaded.

U.S. Pat. No. 4,198,993—Combination Smoking and Drinking Article

An article that serves the dual function of a smoking pipe and drinking receptacle, and thereby permits the concurrent smoking of tobacco and consumption of a beverage through use of a single instrument. The article has the general configuration of a mug, comprising an inner shell that forms a reservoir for holding a beverage and a surrounding outer shell having a smoke input and output means, a smoke chamber normally containing a smoke filtering agent being provided between the inner and outer shells to accommodate the travel of smoke between said input and output means. The smoke chamber is securely sealed from the reservoir to prevent contamination of the beverage by the smoke or filtering agent, while the inner shell serves to conduct heat between the chamber and reservoir to provide auxiliary cooling of the smoke.

U.S. Pat. No. 6,073,632—Compact Spherical Portable Water Pipe for Use with a Standard Beverage Bottle A smoking pipe formed of a spherical body having a top cavity for receiving combustibles, a shank tube receiving cavity, and a mouthpiece tube receiving cavity. An air passage connects the shank tube receiving cavity and the top cavity, and an air passage connects the mouthpiece tube receiving cavity to an exit hole at a lower portion of the spherical body. The shank tube is inserted into the shank tube receiving cavity and the mouthpiece tube is inserted into the mouthpiece tube receiving cavity. The spherical body, when placed over a standard beverage bottle such that the shank tube extends into the bottle interior, forms a substantially air tight seal with the inner rim of the bottle top. Operation as a water pipe is thereby effected.

U.S. Pat. No. 8,689,802—Combination Smoking and Drinking Apparatus

The combination smoking and drinking apparatus includes a generally upright consumable liquid retaining container with an elongated conduit formed therebetween. An inlet is coupled to one end of the conduit and has a combustion compartment therein. Additionally, an outlet is coupled to an opposite end of the conduit such that applying a vacuum to the outlet pressurizes the conduit and draws smoke from the combustion compartment directly through the conduit to the outlet without mixing the smoke with the consumable liquid in the container.

U.S. Pat. No. 9,233,217—Personal Vapor Device Having Disguised Appearance

A personal vapor device having a disguised appearance is disclosed. The personal vapor device has an outer housing and removable lid that replicate the look of a conventional drinking container, such as a water bottle or drinking cup with a straw. An atomizing device, such as a cartomizer, is container and concealed within the open interior of the outer housing. A mouthpiece extends through the removable lid and into the open interior. Atomized liquid from the cartomizer is delivered to the mouthpiece for delivery to the user. A power supply and a control circuit are contained within the open interior and, along with the atomizing device, are concealed within the outer housing. The disguised vapor device can be used without drawing attention to the user.

U.S. Pat. No. 9,788,574—Device for Consecutive Consumption of Liquid from Container and Smoke A device for use with a container containing liquid and having an opening for the consecutive consumption of the liquid and of smoke that has been drawn into the container. The device comprises a body, a combustion receptacle, and a tubular structure. An inlet end of the body engages the container, and an outlet end can be placed at the mouth of a user. The tubular structure connects the combustion receptacle with the interior of the liquid container. When smoking material is combusted and the container is inverted, outflow of liquid from the container through the body, in most instances into a user's mouth, creates negative pressure within the container, drawing in smoke from the combustion receptacle. Once most or all of the liquid has flowed out of the container, the user may then inhale the smoke in the container through the body.

US Application No. 2016/0095351—Hydro Puff

The various embodiments herein disclose a portable puff device comprising a stem, a mouth piece and a filter band. The stem is a tubular structure with a cone or cup shaped holder fixed to one end. The mouth piece is hollow structure comprising a screw structure to be fixed over a mouth of a bottle. The mouth piece comprises an angularly attached puffing pipe. A placement of the puffing pipe is above the mouth of the bottle to allow a flow of air or smoke. The filter band is attached at a junction of the conical holder of the stem and a top portion of the mouth piece. The stem is inserted into the mouth piece and is firmly fitted to the mouth piece through the filter band with conical holder lying above a top portion of the mouth piece.

US Application No. 2016/0183590—Mug with Pipe

An example mug includes a main body forming a telescoped in state and a telescoped out state, and a liner positioned within the main body. With the main body in the telescoped in state, the liner within the main body is configured to hold a liquid so that the mug can be drank from. With the main body in the telescoped out state, the liner is removable so that the main body can be used as a pipe.

WO Application No. 2013/172853—Method and Apparatus for Smoking and Drinking

A smoking and drinking apparatus includes a body member defining an air chamber. A drink reservoir is situated in the air chamber defining a liquid impermeable drink chamber. The drink reservoir is inwardly displaced from the body member to form an air chamber therebetween. A bezel is mounted to the upper edge of the body member that defines a bore in communication with the inner reservoir. The bezel includes an inhalation port through which air is selectively inhaled from the air chamber and an exhalation port through which air is selectively exhaled by a user into the air chamber.

BRIEF SUMMARY OF THE INVENTION

In accordance with one aspect of the invention, a first embodiment of a combination beverage container and smoking apparatus, also referred to as a smoking can apparatus, includes a beverage container, preferably having a generally cylindrical body member formed by a circular sidewall, having a closed top member, with a pre-cut opening to form the mouth of the container and an opening mechanism, and a closed bottom member.

The sidewall of the cylindrical body member may include an indentation to form a smoking bowl, which can take the form of a perforated screen (or any type of pipe screen), or may include one or more holes or perforations for allowing smoke to pass therethrough. The bowl is used for holding the user's smoking substances when the user is ready to use the container as a smoking apparatus. A cover is removably attached to the outer sidewall of the cylindrical body member and covers the smoking bowl. The cover may take the form of a flexible aluminum cover having a pull tab, although it should be understood that other suitable materials and covers may be used.

The sidewall of the cylindrical body member may also include a carburetor, or a small hole, preferably positioned approximately 90 degrees around the sidewall with respect to the position of the bowl, although the carburetor may be placed in any desired or convenient location. In one embodiment, the carburetor takes the form of a small hole that may be temporarily covered by a user's finger or thumb as desired to regulate the amount of air flowing into the container, in order to control the intensity of the smoke entering the container and inhaled by the user. A cover member is removably attached to the outer sidewall of the cylindrical body member and covers the carburetor.

After a user consumes or empties the beverage inside of the beverage container, the user may then remove the covers from the cylindrical body member to expose the smoking bowl and the carburetor on the sidewall of the container. The user then places his or her smoking substance in the bowl, heats the smoking substance, and simultaneously inhales the smoke by placing the user's mouth over the mouth of the container. This apparatus can be used for various smoking substances including, but not limited to, tobacco and cannabis.

In another embodiment, the beverage container may simply include a hole on the side wall thereof, for the purpose of "shotgunning" a beverage. In this embodiment, a cover is removably affixed over the hole, and may be removed when a user is ready to shotgun (quickly guzzle) the beverage. The hole is preferably positioned on the sidewall of the can that is facing upwardly when the can is in a horizontal position with the mouth of the can oriented in the normal drinking position, in order to prevent the liquid inside from draining out of the hole while the beverage is being consumed.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
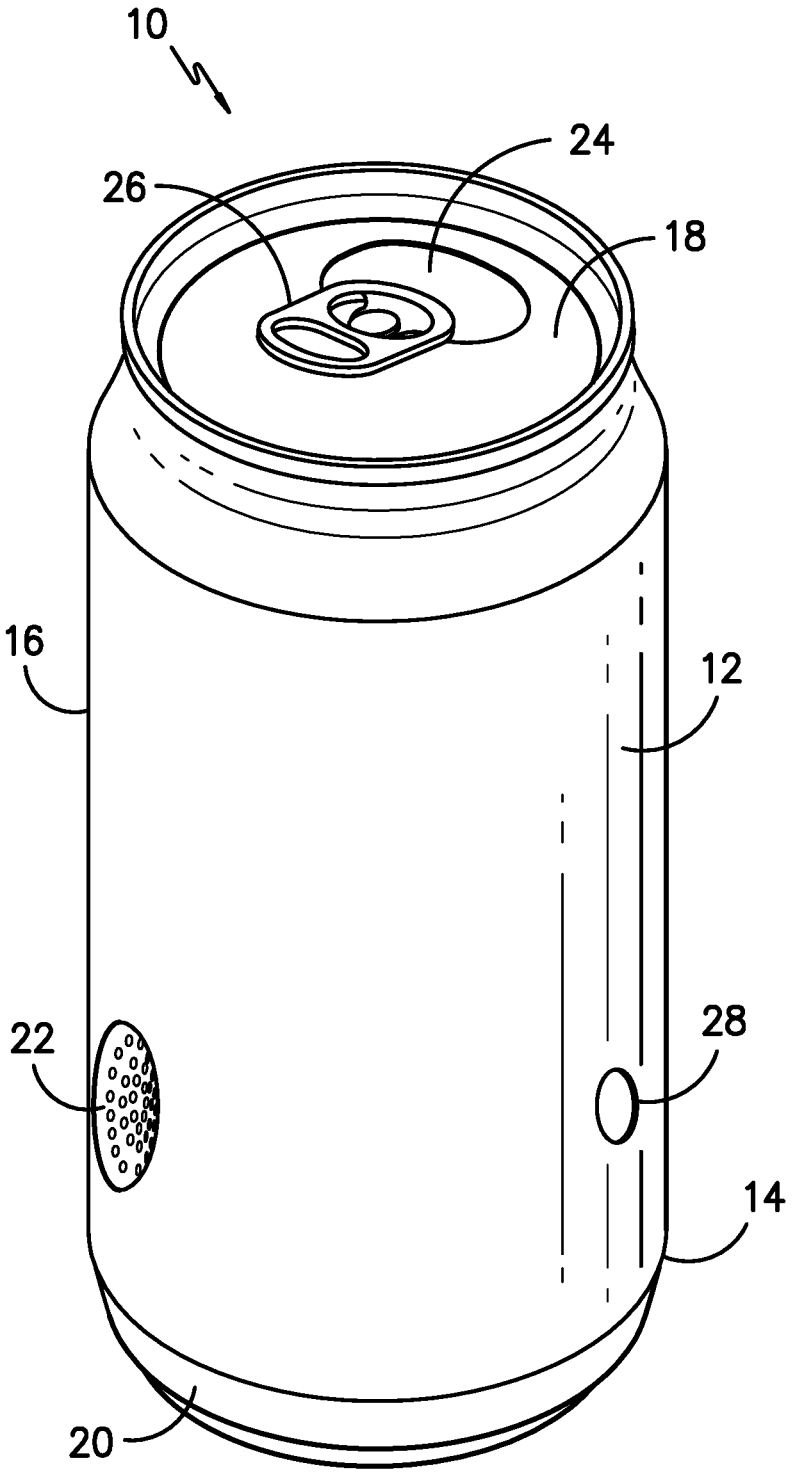
FIG. 1 is a perspective view of one embodiment of the combination beverage container and smoking apparatus ("smoking can apparatus"), wherein the smoking can apparatus is a beverage can, shown here in a vertical orientation, with a generally cylindrical body member formed by a circular sidewall, having a closed top member, with a pre-cut opening to form the mouth of the container and an opening mechanism, a closed bottom member, a smoking bowl positioned on the circular sidewall of the cylindrical body member, and a carburetor positioned approximately 90 degrees around the sidewall with respect to the bowl.
Figure 2:
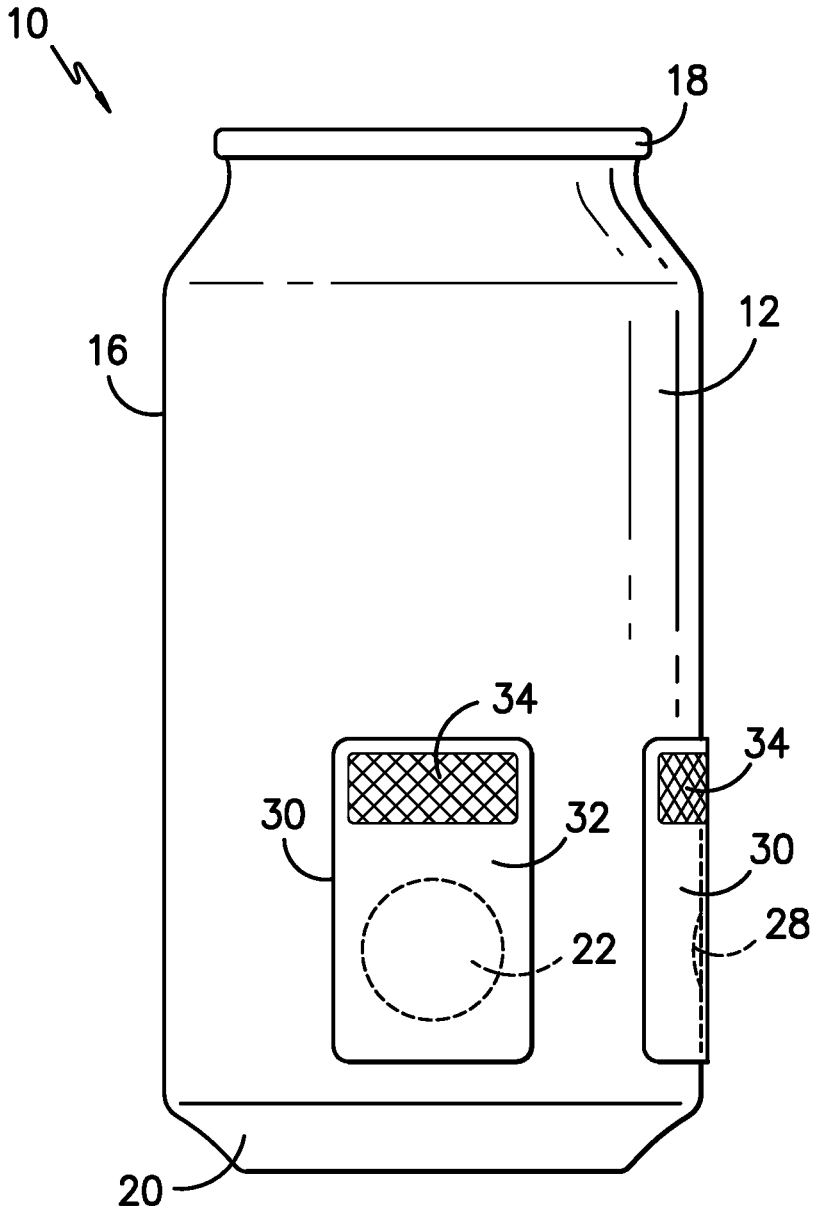
FIG. 2 is a side view of one embodiment of the smoking can apparatus, wherein the smoking can apparatus includes a cover having a pull tab that is removably attached to the circular sidewall and positioned to cover the smoking bowl and a cover having a pull tab removably attached to the circular sidewall and positioned to cover the carburetor.
Figure 3:
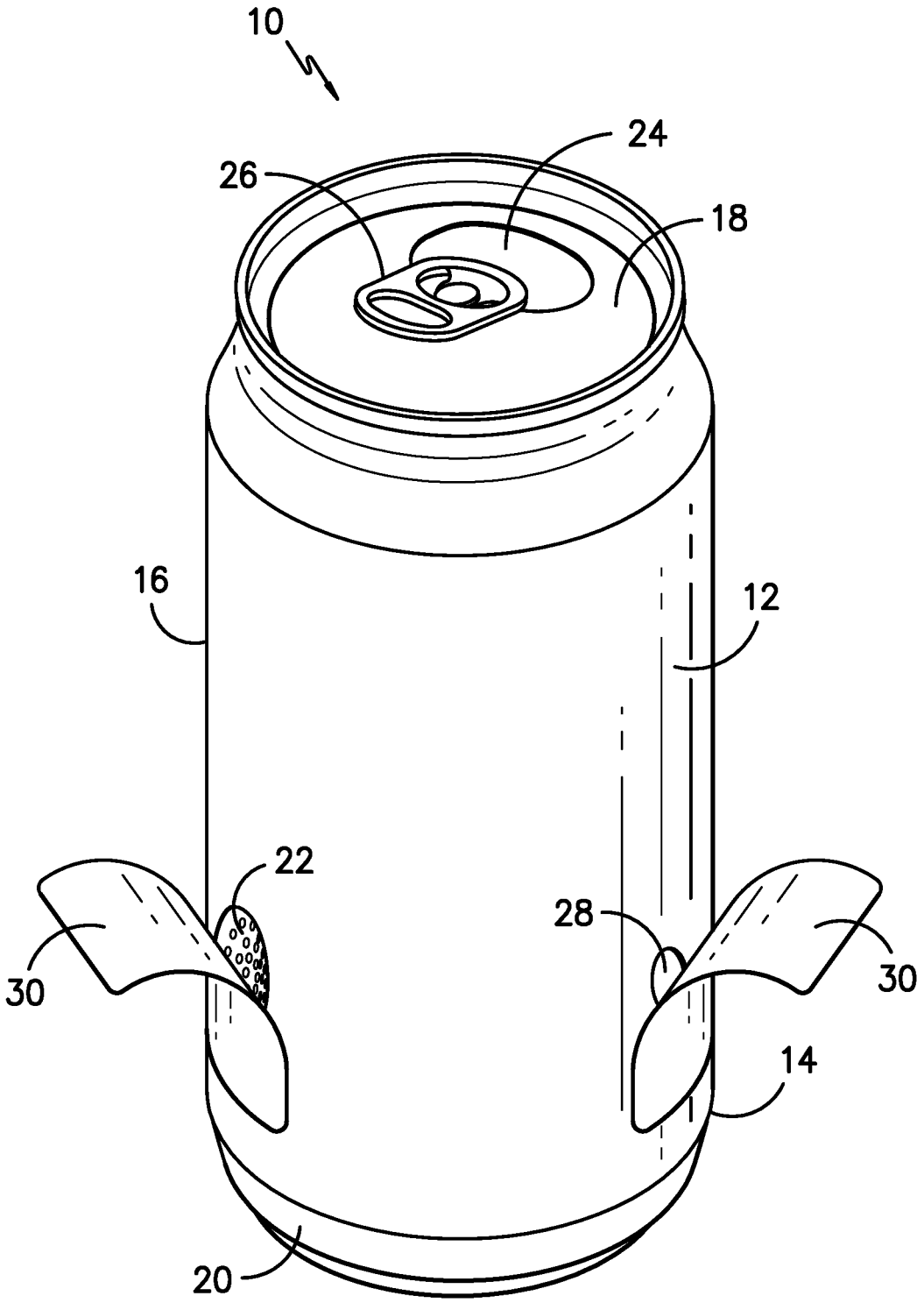
FIG. 3 is a perspective view of one embodiment of the smoking can apparatus, wherein the covers with the pull tab are shown as being partially pulled away from the sidewall of the cylindrical body member to expose the smoking bowl and the carburetor.
Figure 4:
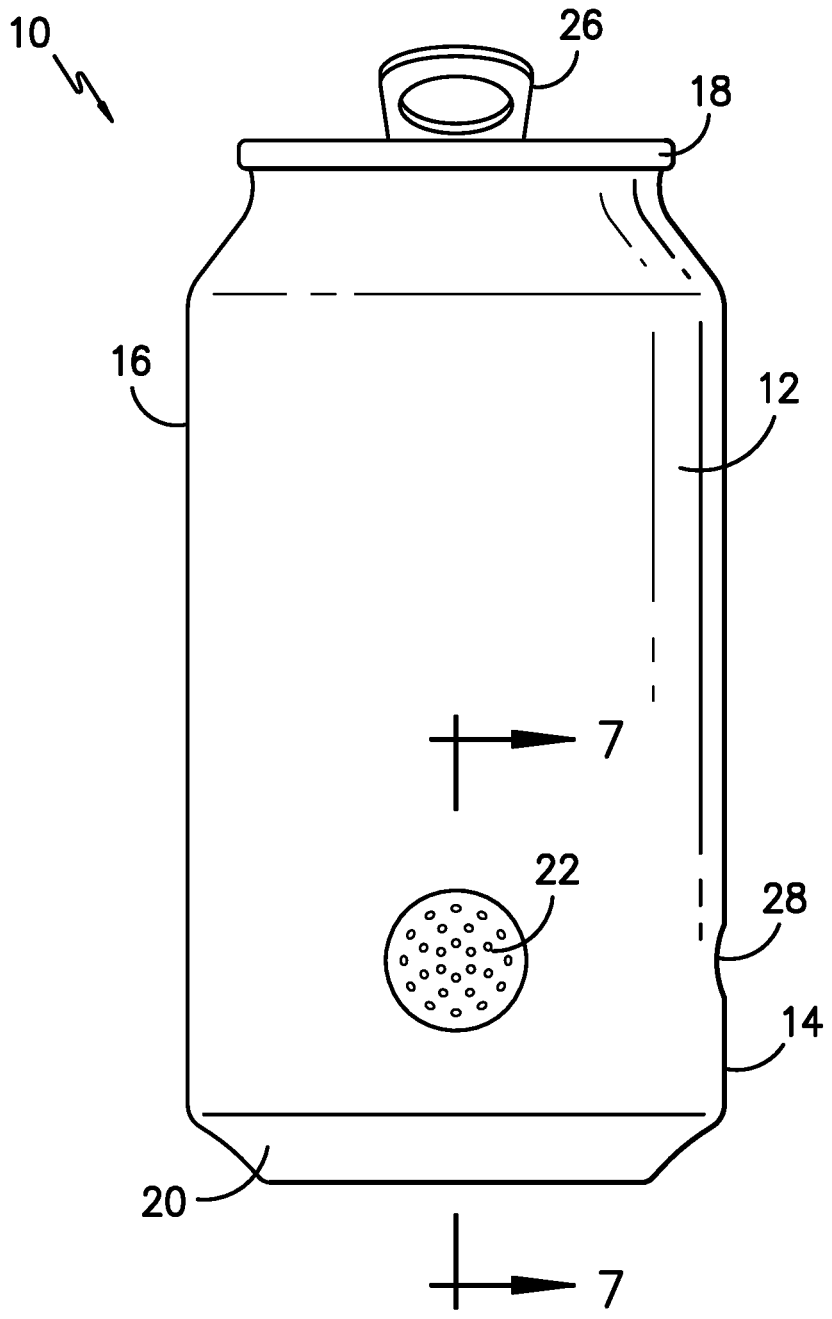
FIG. 4 is a rear view of one embodiment of the smoking can apparatus, wherein the smoking can apparatus includes a concave shaped smoking bowl formed within the sidewall of the cylindrical body member and a carburetor positioned approximately 90 degrees around the sidewall with respect to the bowl.
Figure 5:
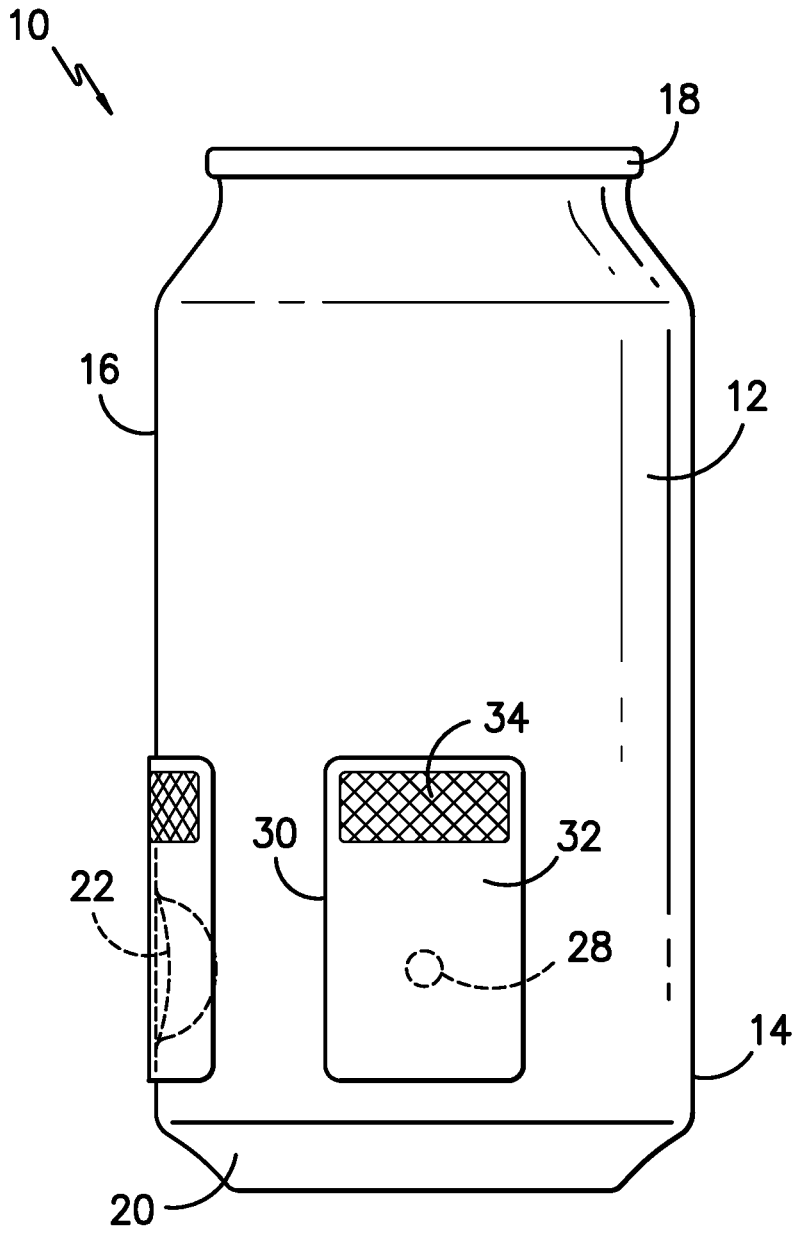
FIG. 5 is a side view of one embodiment of the smoking can apparatus, wherein the smoking can apparatus includes rectangular-shaped removable covers having pull tabs, wherein the covers are positioned over the smoking bowl and carburetor.
Figure 6:
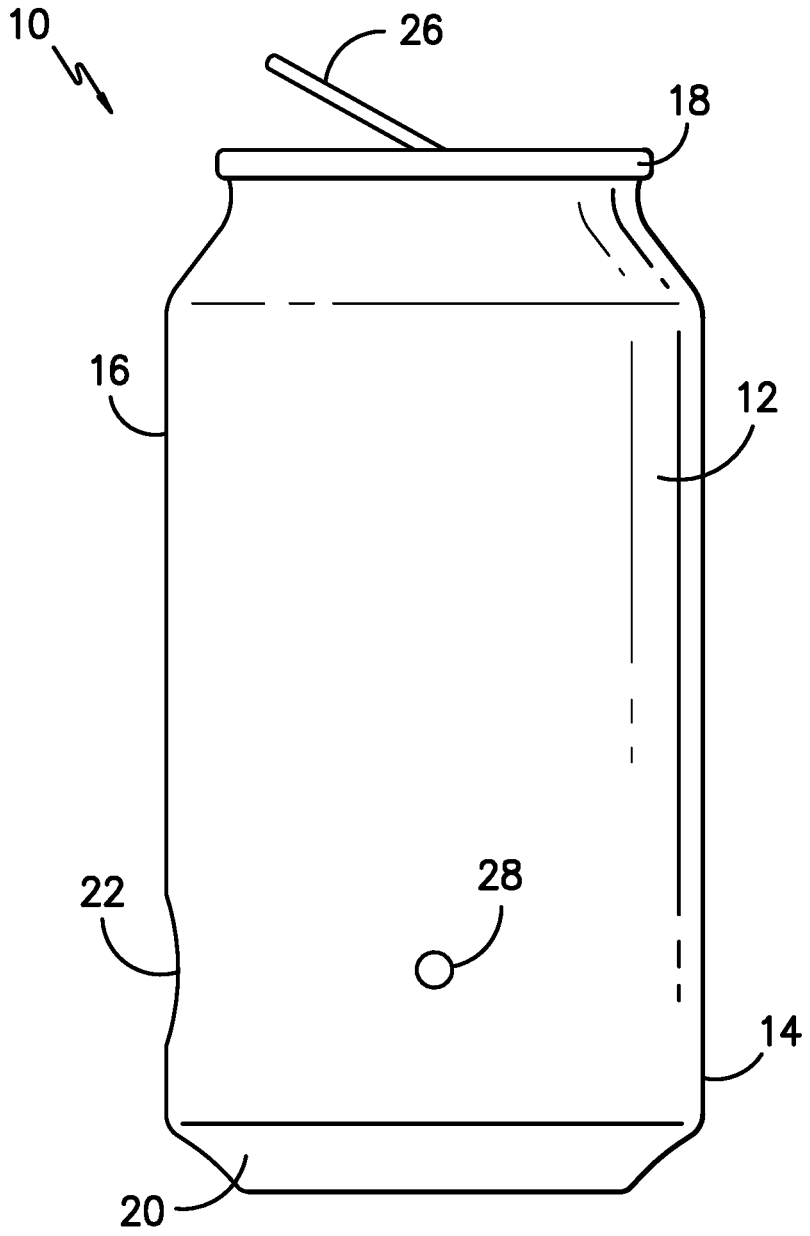
FIG. 6 is a side view of one embodiment of the smoking can apparatus, wherein the smoking can apparatus includes a carburetor, or a small hole, positioned on the sidewall of the cylindrical body member and a smoking bowl approximately 90 degrees around the periphery of the sidewall of the carburetor.
Figure 7:
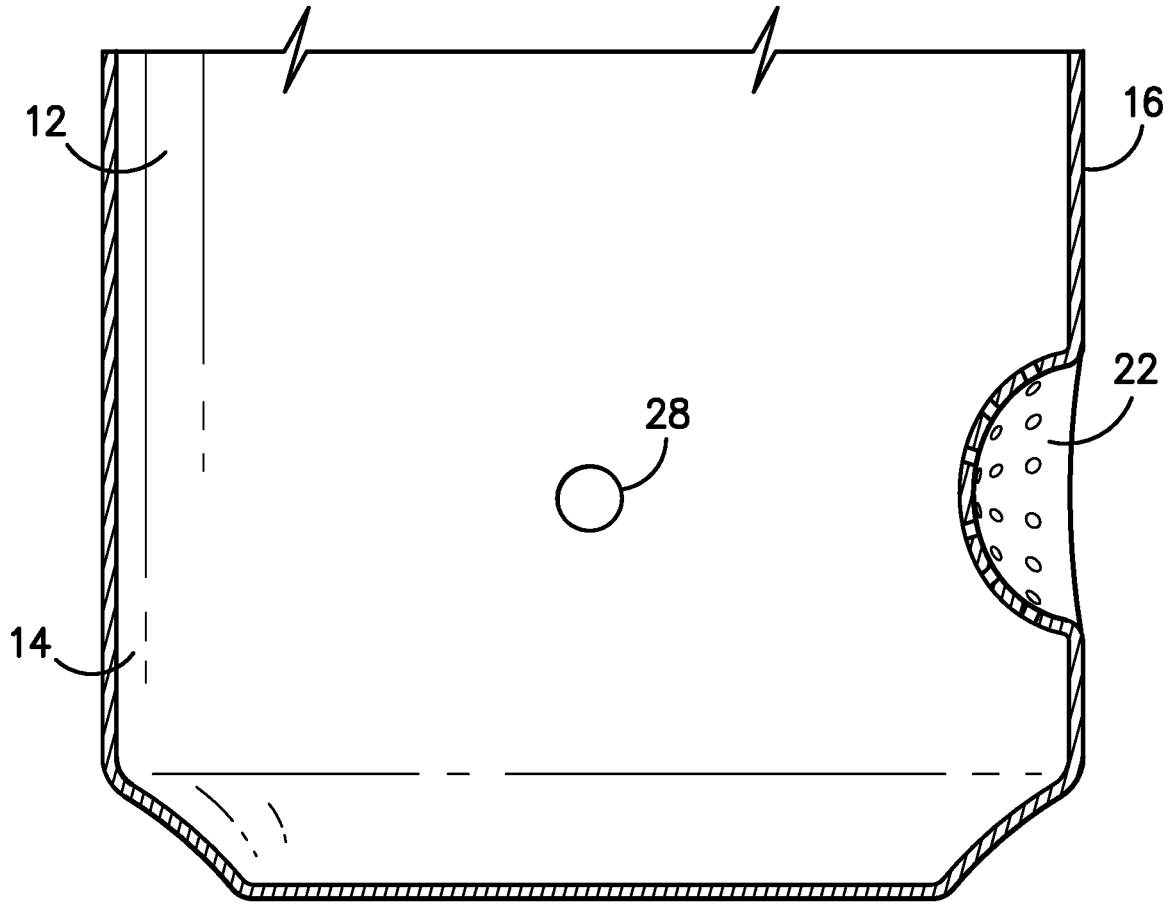
FIG. 7 is a cross-sectional view of FIG. 4 along the lines 7-7, wherein the smoking can apparatus includes a concave shaped smoking bowl and a carburetor formed in the sidewall of the cylindrical body member.
Figure 8:
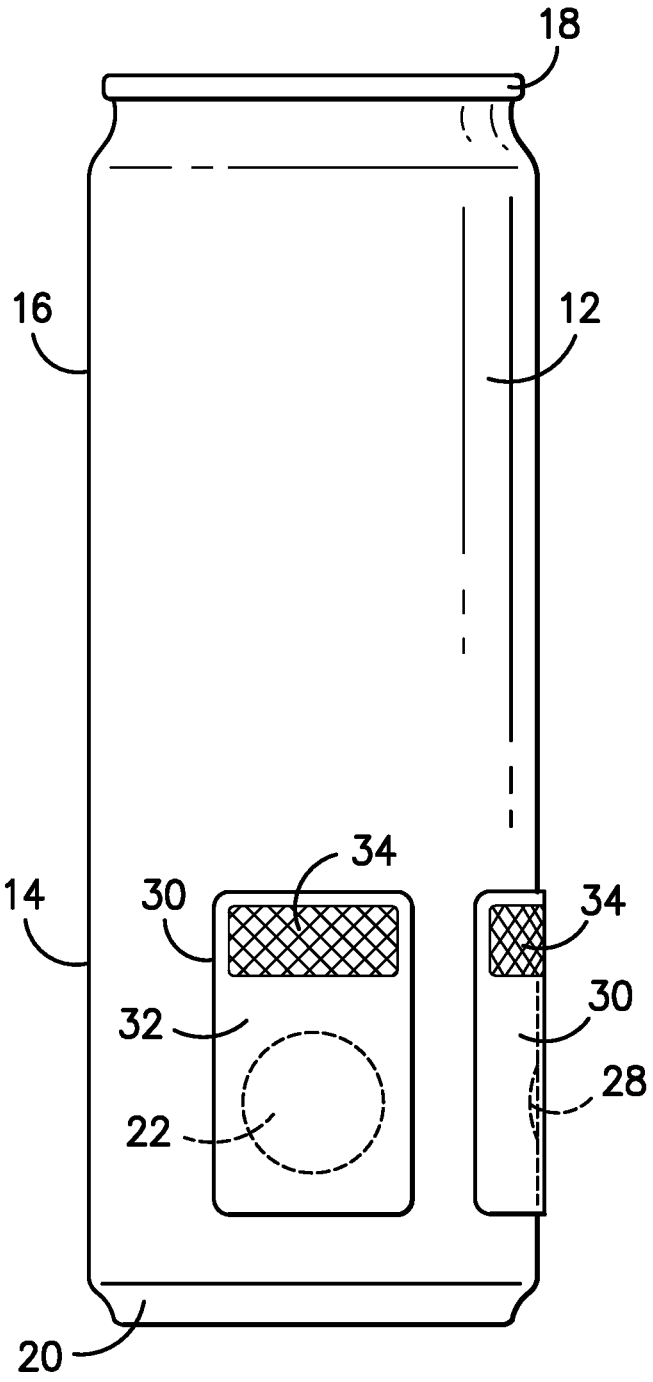
FIG. 8 is a side view of one embodiment of the smoking can apparatus, wherein the beverage container shape is a taller, more slender shape than embodiments shown in FIGS. 1-6 and includes covers having pull tabs positioned over the smoking bowl and carburetor.
Figure 9:
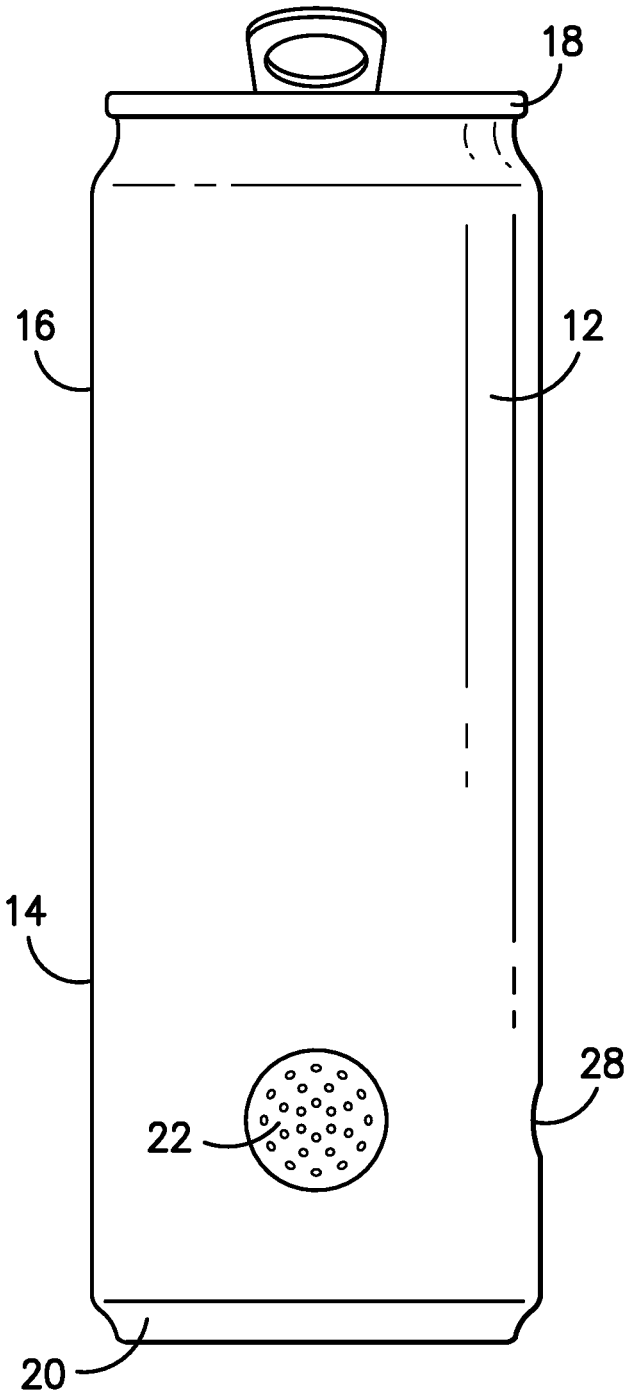
FIG. 9 is a rear view of the embodiment of the smoking can apparatus shown in FIG. 8, and includes the smoking bowl and carburetor on the sidewall of the cylindrical body member in an uncovered state.
Figure 10:
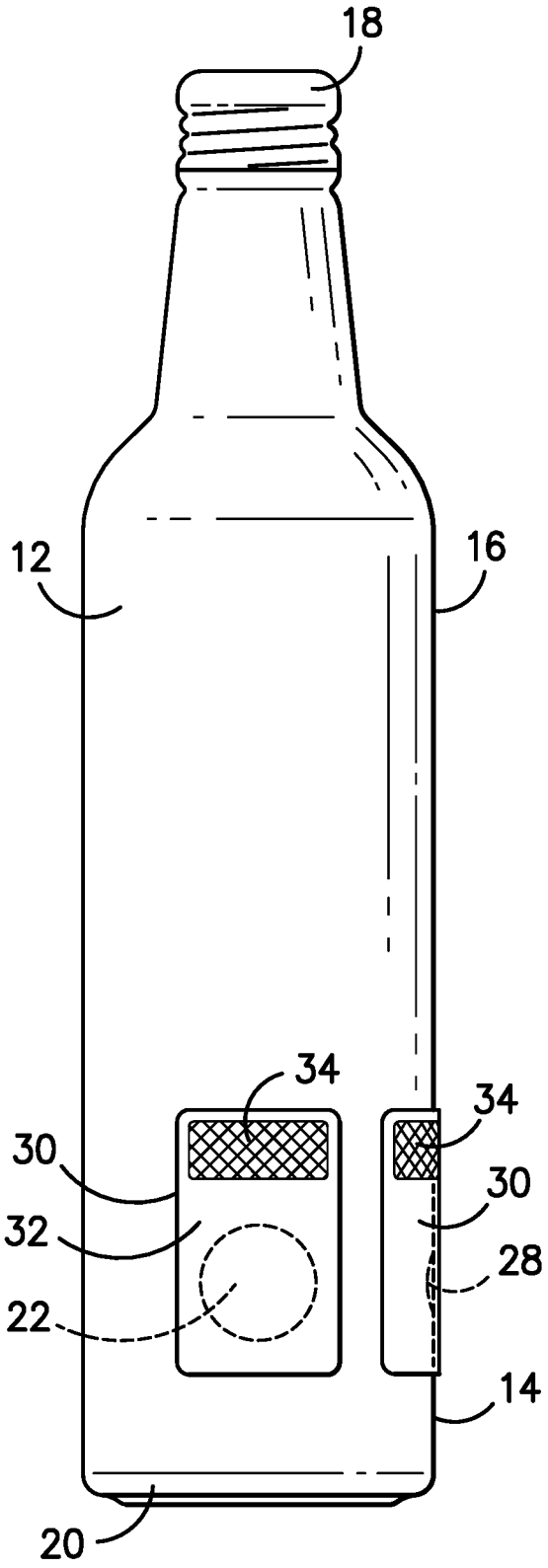
FIG. 10 is a side view of one embodiment of the smoking can apparatus, wherein the beverage container shape is a bottle and includes covers having pull tabs positioned on the side of the cylindrical body member and covering the smoking bowl and carburetor.
Figure 11:
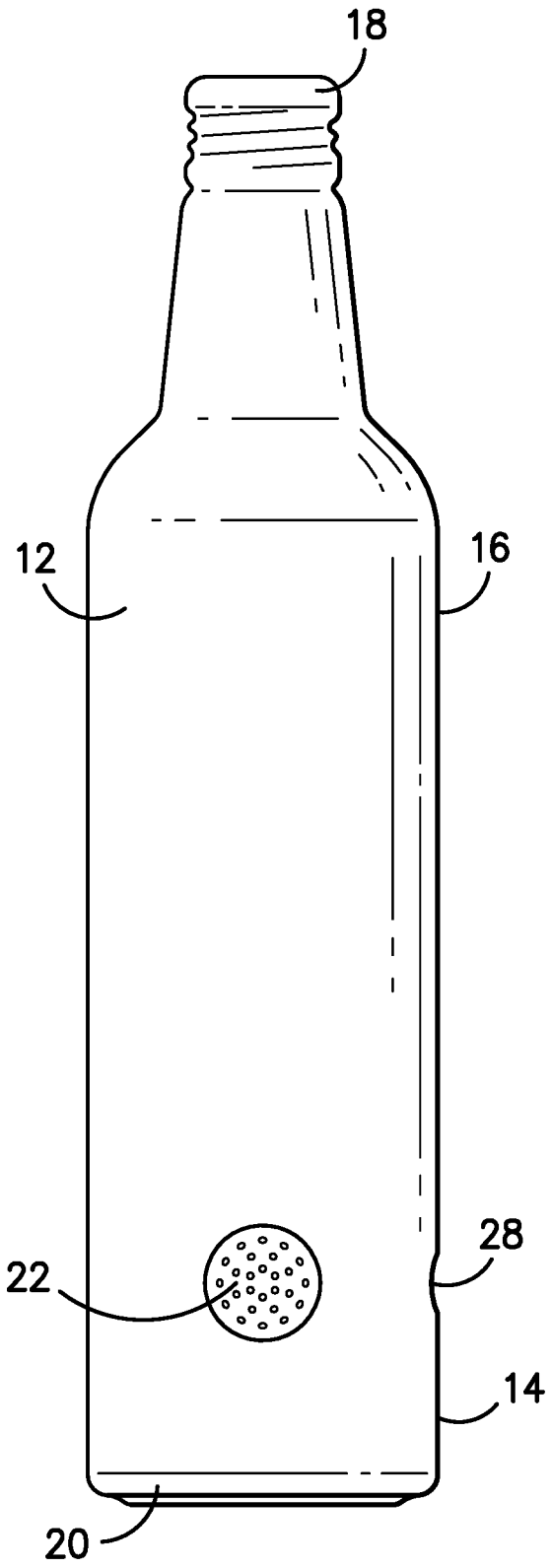
FIG. 11 is a rear view of one embodiment of the smoking can apparatus shown in FIG. 10, further showing the smoking bowl and carburetor in an uncovered state on the sidewall of the cylindrical body member.
Figure 12:
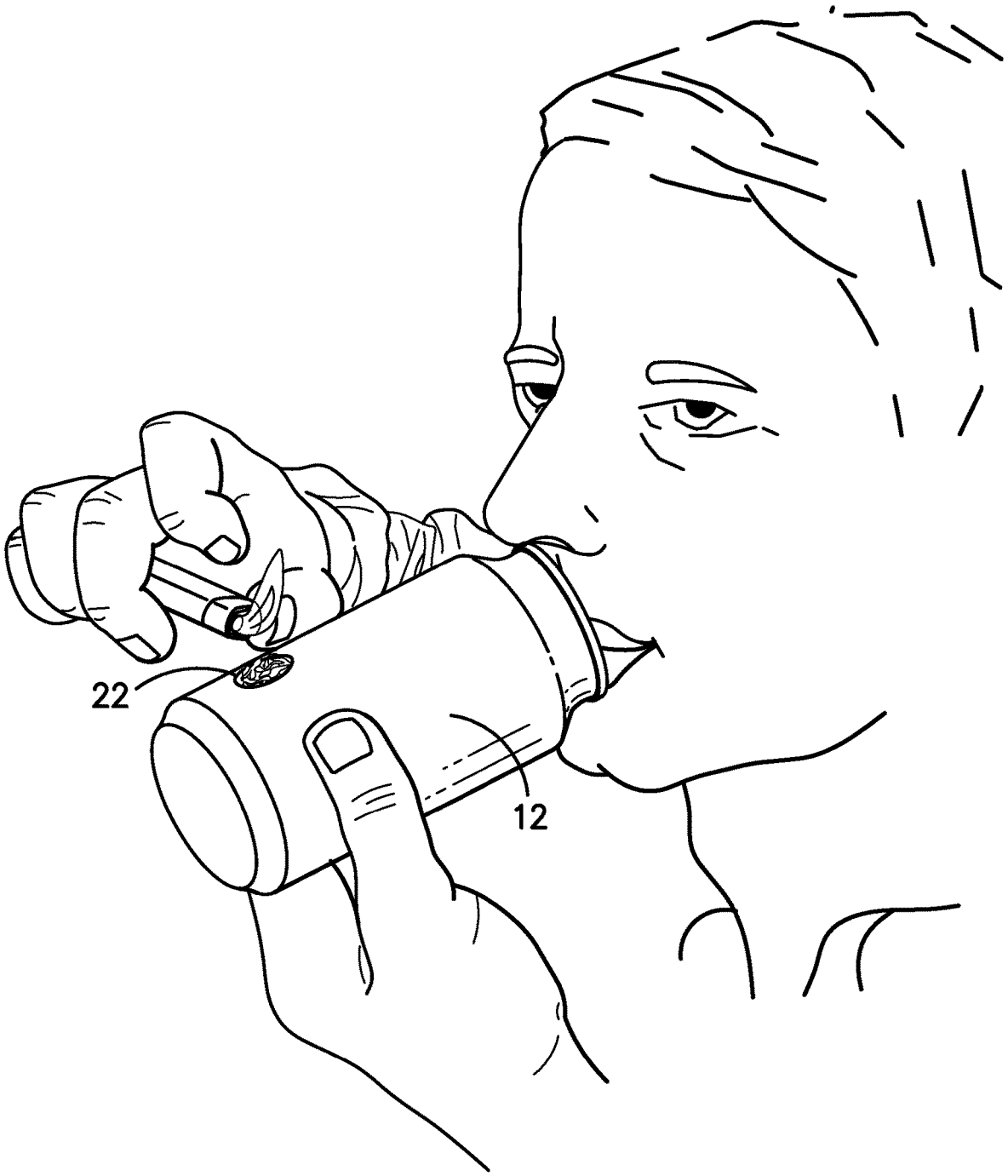
FIG. 12 is a perspective view of one embodiment of the smoking can apparatus in use, wherein the user is holding a flame over the smoking bowl, and the carburetor is positioned underneath the user's thumb.
Figure 13:
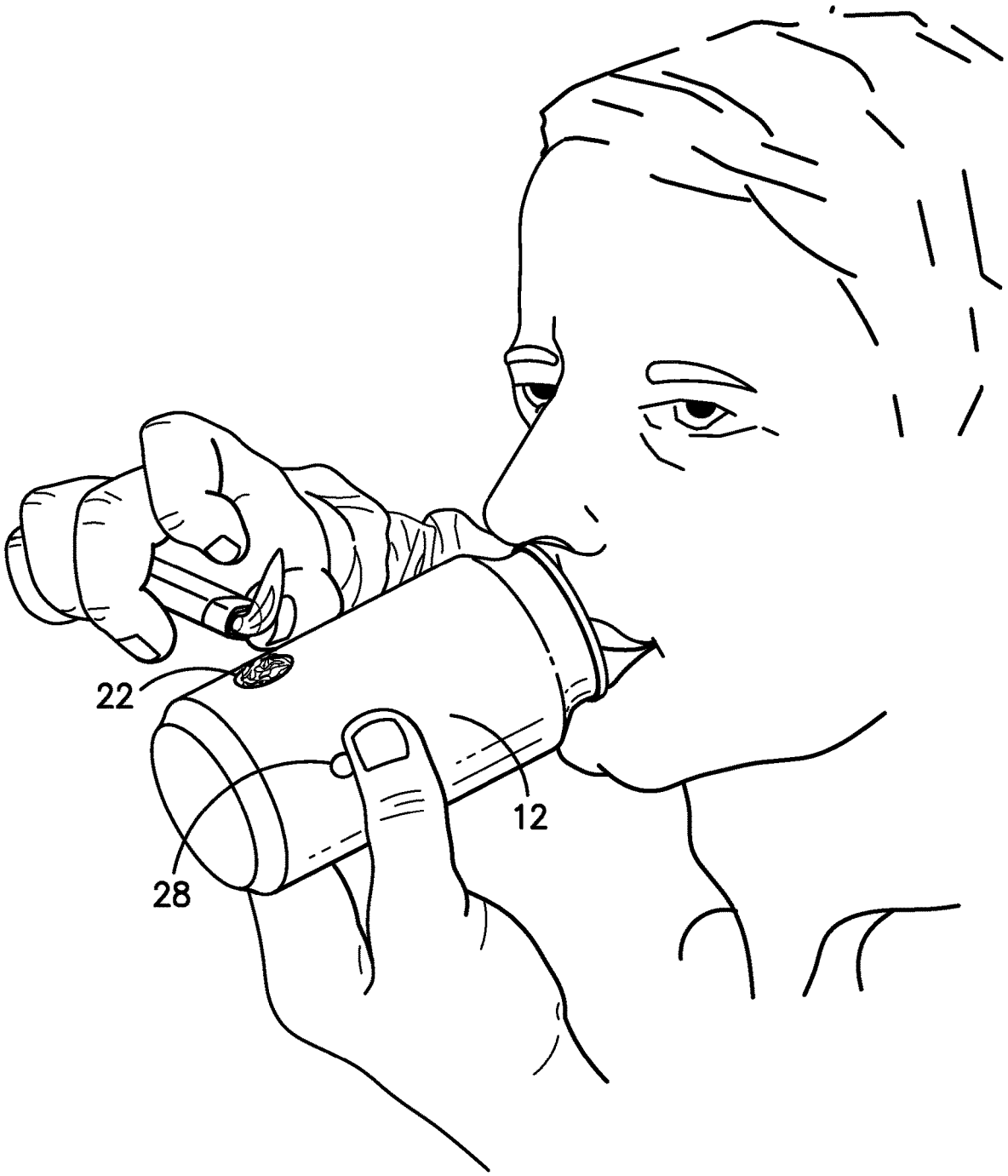
FIG. 13 is a perspective view of one embodiment of the smoking can apparatus in use, wherein the user is holding a flame over the smoking bowl, and the user's thumb is positioned away from the carburetor.

The present invention includes, in a first embodiment, a combination beverage container and smoking apparatus ("smoking can apparatus") 10, as shown in FIGS. 1-13, and includes a beverage container 12 with a generally cylindrical body member 14 formed by a circular sidewall 16, a closed top member 18 attached to the top edge of the container 12, a closed bottom member 20 attached to the bottom edge of the container 12, and a concave shaped smoking bowl 22 formed in the sidewall 16 of the cylindrical body member 14. The closed top member 18 includes a pre-cut opening to form the mouth of the container 24 and an opening mechanism 26, such as an aluminum tab or the like, in the manner of conventional soda or beer cans.

In a preferred embodiment, the smoking bowl 22 is a generally concave indentation, located on the sidewall 16 of the cylindrical body member 14, and which includes one or more holes through which smoke can pass. The smoking bowl 22 may take one of many forms, such as a perforated screen, or the smoking bowl 22 may simply be an indentation on the side of the container 12 that includes one or more holes or perforations for allowing smoke to pass therethrough. The smoking bowl 22 may take the form of a perforated screen such as the Stanker® pipe screens. These screens are well known in the art for pipes used for smoking tobacco or cannabis. The smoking bowl 22 is where the user places his or her smoking substances when ready for use. The small holes in the bowl 22 allow the smoke from the smoking substances to enter into the body member 14 of the container 12, while retaining the smoking substance within the bowl 22. In this way, the bowl 22 acts as a filter, similar to other traditional types of smoking bowls. In use, a user may place the smoking material into the bowl 22, light the smoking material with a lighter or the like, and inhale the smoke through the mouth of the container 24 on the closed top member 18 of the body member 14.

In an alternate embodiment, the combination beverage container and smoke apparatus 10 may include a carburetor 28, or a small hole, on the sidewall 16, preferably oriented about 90° around the periphery of the sidewall 16 with respect to the bowl 22, as shown in FIGS. 1-7. The purpose of the carburetor 28 is to regulate the amount of ambient air that flows into the container 12, so that the user may control the intensity of the smoke being inhaled. When a user places his or her finger or thumb on the carburetor 28 opening, the intensity of the smoke increases by preventing ambient air from mixing with the smoke emanating from the bowl 22. When the user removes his or her finger or thumb from the carburetor 28, more ambient air is allowed to mix with the smoke, so that the intensity of the smoke being inhaled is decreased. The carburetor 28 can be positioned on either side of the bowl 22 to accommodate right-handed and left-handed users, or in any other desired location on the beverage container 12. It should be understood that the carburetor may be positioned at any desired location on the smoking can apparatus.

In a preferred embodiment, the combined beverage container and smoking apparatus 10 includes a first cover 30 removably attached to an outer portion of the sidewall 16 such that the cover 30 is positioned over the smoking bowl 22. Another cover 30 is removably attached to the sidewall 16 to cover the carburetor 28. The covers 30 are preferably made from a sturdy but flexible aluminum material, and preferably include pull tabs 32. It should be understood that any other suitable materials may be used to form the covers. The purpose of these covers is to essentially plug the openings or holes in the side of the beverage container 12 formed by the bowl 22 and carburetor 28, to prevent the beverage from leaking or draining out of the beverage container 12 through the bowl 22 and carburetor 28. The adhesive on these covers 30 is preferably strong enough to maintain the cover 30 in place over the bowl 22 and carburetor 28, even when the internal pressure within the beverage container 12 increases due to temperature or jostling caused during shipping and handling. However, the adhesive should also allow a user to easily remove the covers 30 from the container 12 by grasping the pull tab 32 and peeling the covers 30 away without undue difficulty. The pull tab portion 32 of the cover 30 preferably includes a textured section 34, as shown in FIGS. 2, 5, 8, and 10, to make it easier for the user to grip the pull tab 32 when removing the pull tab 32 from the cylindrical body member 14.

Once the user has opened the beverage container 12 using the opening mechanism 26 and removed the liquid from inside, the container 12 is ready for use as a smoking apparatus. To use as a smoking apparatus, the user may remove the first cover 30 over the bowl 22 by grasping the pull tab 32 and peeling the cover 30 away from the sidewall 16 of the container 12, exposing the bowl 22 in the sidewall 16. The user may also remove the second cover 30 from the container 12 in a similar manner, thereby exposing the carburetor 28. The bowl 22 may take the form of a concave screen, such as the Stanker® pipe screens, flat screens, or may simply be an indentation having one or more holes or perforations for holding the smoking substance while allowing smoke to flow therethrough and into the container. The user may then place any desired smoking substance into the bowl 22 and orient the apparatus 10 in a generally horizontal position with the bowl 22 facing upwardly to contain the smoking materials. The user will place his mouth over the mouth of the container 24 and heat the smoking substances by providing a heat source, such as a flame, to the smoking substances. As the smoking substances heat up, the user inhales through the mouth of the container 24, thus drawing smoke from the bowl 22, through the container 12, out of the mouth of the container 24, and into the user's lungs.

To regulate the intensity of the smoke, the user can intermittently place his or her finger on the carburetor 28, in order to regulate the intensity of the smoke, as described hereinabove. If the user is right-handed, the user may hold the container 12 with his or her left hand and use his or her right hand to operate the lighter. Right handed users typically hold the container 12 in their left hand while using the right hand to light the bowl 22, and in that case, the carburetor 28 is preferably positioned on the left side of the container 12, so that the right handed user may use his or her left thumb to intermittently cover the carburetor 28. For left-handed users, the operation is reversed, and the carburetor 28 is preferably positioned on the right side of the container 12 as the bowl 22 faces upwardly.

In one embodiment, the shape of the beverage container 12 may be of a standard soda can, which is well known in the art. In another embodiment, the shape of the beverage container 12 may be a taller, more slender shape, such as the popular hard seltzer brands White Claw® or Truly®. Alternatively, the shape of the beverage container 12 may be more like a bottle, such as the aluminum beer bottles used to contain Bud Light®. It should be understood that any type of aluminum or other metal beverage container may be used and adapted to include the bowl 22, the carburetor 28, and the pull tabs 32.

In an alternate embodiment, the combination beverage container and smoking apparatus 10 may include a hole 36 on the sidewall 16 of the beverage container 12 and a cover 30 with a pull tab 32 positioned to cover the hole 36. This is to allow users to peel the cover 30 away and "shot gun" the beverage within the container 12. According to Wikipedia, "shutgunning" a beverage refers to the act of "consuming a beverage, especially beer, very quickly by punching a hole in the side of the can, near the bottom, placing the mouth over the hole, and pulling the tab to open the top. To "shotgun" a beverage out of the beverage container 12, the user would simply peel the cover 30 away from the hole 36, place his or her mouth over the hole 36, open the container 12 using the opening mechanism 26 located on the closed top member 18, and quickly consume the beverage.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A combination beverage container and smoking apparatus for smoking various substances, comprising:

a beverage container that contains a beverage, wherein said container is a generally cylindrical body member formed by a circular sidewall;

a closed top member attached to a top edge of said sidewall, wherein said top member includes a pre-cut opening to form a mouth and an opening mechanism, said pre-cut opening being in a closed position for containing said beverage until being opened by said opening mechanism;

a closed bottom member attached to a bottom edge of said sidewall;

a generally concave-shaped bowl formed within said sidewall of said cylindrical body member; and a first cover member removably attached to an outer portion of said circular sidewall such that said first cover is positioned over said bowl.

2. The combination beverage container and smoking apparatus set forth in claim 1, wherein said bowl is selected from the group consisting of a concave shaped screen member, a flat screen, and a concave indentation defining at least one hole therein.

3. The combination beverage container and smoking apparatus set forth in claim 1, wherein said first cover member is made from an aluminum material.

4. The combination beverage container and smoking apparatus set forth in claim 1, further including a carburetor positioned on said sidewall of said container, and a second cover member that is removably attached to said sidewall and is positioned over said carburetor.

5. A beverage container comprising:

a beverage container that contains a beverage, wherein said container is a generally cylindrical body member formed by a circular sidewall;

a closed top member attached to a top edge of said sidewall, wherein said top member includes a pre-cut opening to form a mouth and an opening mechanism, said pre-cut opening being in a closed position for containing said beverage until being opened by said opening mechanism;

a closed bottom member attached to a bottom edge of said sidewall;

a hole formed within said sidewall of said cylindrical body member; and a first cover member removably attached to an outer portion of said circular sidewall such that said cover is positioned over said hole.

6. The combination beverage container and smoking apparatus set forth in claim 5, wherein said first cover member is made from an aluminum material.

7. A method for converting a beverage container into a smoking apparatus comprising:

providing a beverage container that contains a beverage, said container having a sidewall and a closed top, said closed top having a pre-cut opening to form a mouth and an opening means, and a closed bottom;

providing a generally concave-shaped bowl formed within said sidewall of said beverage container; and providing a first removable cover positioned over said bowl.

8. The method for converting a beverage container into a smoking apparatus set forth in claim 7, further including:

providing a carburetor positioned on said sidewall of said container, and a second removable cover positioned over said carburetor.

9. The method for converting a beverage container into a smoking apparatus set forth in claim 8, further including:

opening said container using said opening means and emptying said beverage;

removing first said cover and exposing said bowl; and removing second cover and exposing said carburetor.

10. The method for converting a beverage container into a smoking apparatus set forth in claim 7, further including:

opening said container using said opening means and emptying said beverage;

removing said first cover and exposing said bowl;

placing smoking substances on said bowl of said sidewall;

placing user's mouth to said pre-cut opening on said closed top to inhale the smoke; and heating said smoking substances using a flame and inhale from said pre-cut opening.

11. The method for converting a beverage container into a smoking apparatus set forth in claim 10, further including:

alternating user's finger between a covered position and an uncovered position over said carburetor to regulate air flow into said container to control intensity of said smoke.

* * * * *